United States Patent [19]

Beery

[11] 4,392,950

[45] Jul. 12, 1983

[54] CENTRIFUGAL TYPE CLEANER

[75] Inventor: James P. Beery, Springfield, Ohio

[73] Assignee: The Bauer Bros. Co., Springfield, Ohio

[21] Appl. No.: 351,471

[22] Filed: Feb. 23, 1982

Related U.S. Application Data

[63] Continuation of Ser. No. 827,066, Aug. 23, 1977, abandoned.

[51] Int. Cl.[3] ..... B04C 5/14

[52] U.S. Cl. ..... 209/211; 210/512.1

[58] Field of Search ..... 209/211, 144; 210/512.1

[56] References Cited

U.S. PATENT DOCUMENTS

| | | | |
|---|---|---|---|
| 2,375,826 | 5/1945 | Scott | 209/211 |
| 2,717,695 | 9/1955 | Martin | 209/211 |
| 2,757,581 | 8/1956 | Freeman et al. | 209/211 |
| 3,440,806 | 4/1969 | Damratowski | 209/211 X |
| 3,696,927 | 10/1972 | Jakobsson et al. | 209/211 |
| 3,862,041 | 1/1975 | Robinson | 209/211 X |

FOREIGN PATENT DOCUMENTS

| | | | |
|---|---|---|---|
| 1642900 | 9/1972 | Fed. Rep. of Germany | 209/211 |

*Primary Examiner*—Ralph J. Hill

*Attorney, Agent, or Firm*—Jerome P. Bloom

[57] ABSTRACT

A centrifugal type cleaner or separator, the separating chamber of which is provided, in its interior, with a sudden and sharp reduction of its cross-sectional area by means at the outer periphery of which is an escape passage for the deflected portion of a vortex type flow. The arrangement provides that as a slurry is moved through the chamber in a vortex type flow, the outer portion of the flow including the larger and lighter solids in the slurry, it is intended to reject, will be deflected to the escape passage while the remaining heavy and small solids will find an exit through the underflow nozzle of the cleaner. In the preferred embodiment here illustrated the escape passage is designed to maintain a vortex type flow pattern for the escaping material.

11 Claims, 7 Drawing Figures

FIG-1
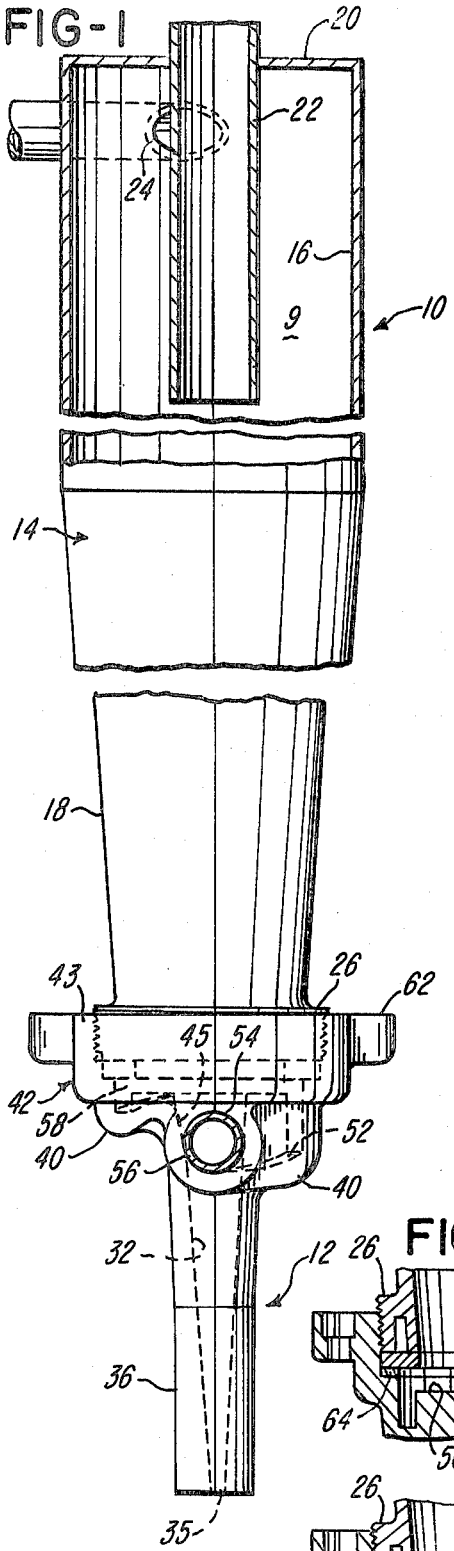
FIG-2
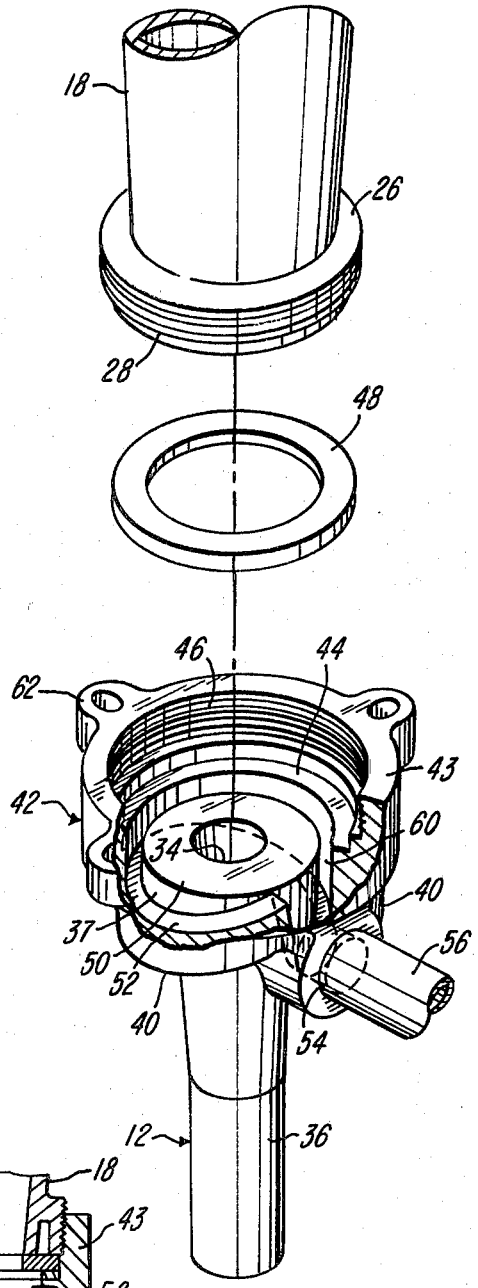
FIG-5
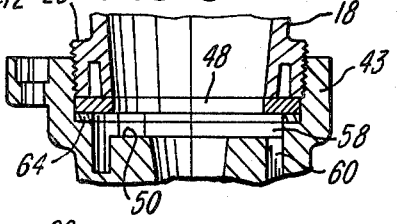
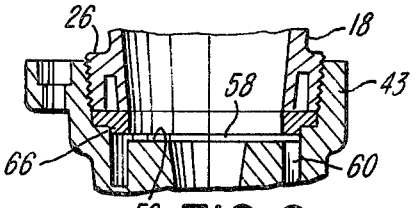
FIG-6
FIG-7
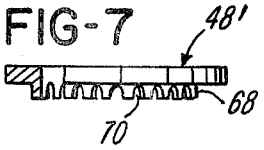

CENTRIFUGAL TYPE CLEANER

This application is a continuation of application Ser. No. 827,066, filed Aug. 23, 1977, now abandoned.

BACKGROUND OF THE DISCLOSURE

This invention relates to new and improved centrifugal cleaners and separators. For purpose of convenience, it is to be understood that any reference herein to cleaners shall be considered to likewise include a reference to separators.

The present invention was developed in the process of trying to overcome problems evidenced in the use of prior art centrifugal cleaners in the pulp and paper industry stemming from the adoption of the "whole tree" chip concept. This concept resulted from the need to utilize as much of a tree as possible in preparing pulp, due to diminishing resources, and, more importantly, to reduce the number of operations, the investment in capital equipment and thereby the cost of preparing raw material for conversion to pulp.

Since adoption of the "whole tree" chip concept and its application in pulping procedures, pulp slurry delivered to centrifugal cleaners for separation of good fiber materials will in many cases include significantly increased quantities of bark and the underlying cambium layer the character of which is unlike normal shives and fibers. This material tends to interfere with the normal operation of the cleaner and reduces its efficiency. Moreover, the nature and quantity of the cambium layer involved is often such that it has been found difficult to remove it from a slurry, particularly in a single pass through a centrifugal cleaner. The bark particles also carry embedded impurities. This last raises the normal percentage of what might be called "rejects" entrained in the slurry.

The foregoing problem has been compounded by governmental requirements to close water systems in pulp and paper mills so discharge of pollutants may be better controlled. This has resulted in an increase in temperature of the liquid employed, which is caused thereby to have a lower viscosity, undesirably affecting the cleaning or separating ability of the centrifugal cleaner. What happens within a cleaner in such case is that as slurry moves through the cleaner in a vortex type flow pattern, producing counterflowing vortices, the liquid tends to release from the entrained solids and move to the inner vortex in the cleaner much more quickly than it would under usual temperature conditions. The entrained solids are left adjacent the cleaner wall and by reason of their thickened and matted condition they tend to trap individual fibers which otherwise would normally have been carried into the center of the cleaner for flow to and through its accepts nozzle. This abnormal behavior of the vortex flow produces intermingling of dirt and fibers in a manner that fibers will oftentimes carry dirt to the inner vortex, consequently increasing the objectionable solids reaching the accepts nozzle. At the same time a good portion of the fibers which should flow through the accepts nozzle remain entangled with the solids directed to the rejects or underflow nozzle of the cleaner. Limiting rejects does not help the situation as one would normally expect since this can cause plugging of the rejects nozzle and failure of the cleaner system to operate as intended.

The solution of the foregoing problems was the target of the efforts which resulted in the present invention.

SUMMARY OF THE INVENTION

Embodiments of the present invention comprises a centrifugal cleaner shell including means for inflow of a slurry the constituents of which are to be separated into accepted and rejected portions, an overflow nozzle, an underflow nozzle, and, intermediate said nozzles, means in the path of an outer peripheral section of the vortex type flow of the slurry which moves through the cleaner to direct from the cleaner, intermediate its ends, a relatively dilute fraction of the slurry embodying light and large solid particles while a further fraction containing smaller and heavier solid particles is subsequently directed to and through the underflow nozzle. At the same time the conventionally produced counterflow along the central axis of the cleaner directs the accepts of the slurry to exit from the cleaner by way of its overflow nozzle.

In a preferred embodiment illustrated the cleaner is a two-part unit. One part including its tangential inlet forms one section of the separating chamber of the cleaner the diameter of which at its minimum is greater than the maximum diameter of that portion of the separating chamber defined by the second part. As the two parts are coupled, one forms a coaxial extension of the other. By reason of the difference in its internal diameter, the second part presents, to the chamber portion formed by said first part, an essentially annular end surface portion which lies in the path and generally transverse to the course of flow of a slurry which passes through the cleaner. This annular end surface portion faces that end of the cleaner including its overflow nozzle. Intermediately of their inner wall surfaces defining said chamber, the adjacent ends of the coupled parts are axially spaced and have means therebetween by which this spacing may assume one dimension or another. The axial spacing, which may be selectively dimensioned, provides an annular passage which leads from said annular end surface portion of the second part to a spirally configured passage peripheral thereto. As here provided, the spiral discharge passage is directed in an axial sense and the outer periphery of its discharge end communicates with an exit defined by a radial opening to the outer surface of the cleaner shell.

While the second part is described and illustrated as a single element, it will be obvious that it can be made of separable parts.

The embodiments of the invention provide an effective means for removing solids, commonly called "rejects", including impurities, from a cellulose suspension and for separating the solids into two relatively distinctive fractions, one of which contains primarily the larger, lighter and potentially usable solids and the other the smaller and heavier solids which have little possible use. In this respect the invention units have unique results particularly illustrated in application to refined wood fiber material which is derived from whole trees in that it is unexpectedly the large and light pieces of bark, shives, etc. that comprise the first fraction extracted from a slurry which moves therethrough in a vortex type flow. Consider that this first fraction is drawn from the periphery of the flow, intermediate its ends, while the heavier rejects move to the underflow end of the units. No explanation has been found for this phenomenon but it nevertheless occurs.

It has been known to place obstructions to slurry flow interiorly of a centrifugal cleaner. This to the present inventor's knowledge is exemplified by the following U.S. Pat. Nos.:

2,706,045
3,052,361
3,385,437
3,533,506
3,928,186

It may also have been previously considered to divide rejects into parts but of any pertinent disclosure of this type of art specific to the presently disclosed concept the present inventor is not aware.

For some possible remote pertinence, however, note U.S. Pat. No. 2,769,546.

It is a primary object of the invention to provide improvements in centrifugal cleaners or separators rendering them more efficient and satisfactory in use, adaptable to a wider variety of applications and unlikely to malfunction.

Another object is to provide a centrifugal cleaner or separator capable of more effectively handling a slurry with large quantities of embodied solids, including solids such as bark, the underlying cambium layer and other floatable materials.

A further object is to provide a cleaner or separator having plural rejects outlets constructed and arranged so that it separates light and large solids comprising "rejects" at an early stage of the vortex flow therethrough and then separates therefrom the smaller and heavier solids.

An additional object is to provide a centrifugal type cleaner or separator having an opening in the wall of its separating chamber leading to an exit from said chamber intermediate its ends and means within said chamber, adjacent said opening, operative on a vortex flow of a slurry through the chamber to deflect a portion thereof including larger and lighter solids to and through said opening.

Another object is to provide a centrifugal cleaner or separator possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of embodiment of the invention is illustratively set forth, FIG. 1 is a view of the cleaner unit per the present invention shown in a vertical orientation and partly in section;

FIG. 2 is an exploded perspective view of the portion of the cleaner of FIG. 1 which embodies its inventive features, partly broken away for clarity of disclosure;

Figure 3:
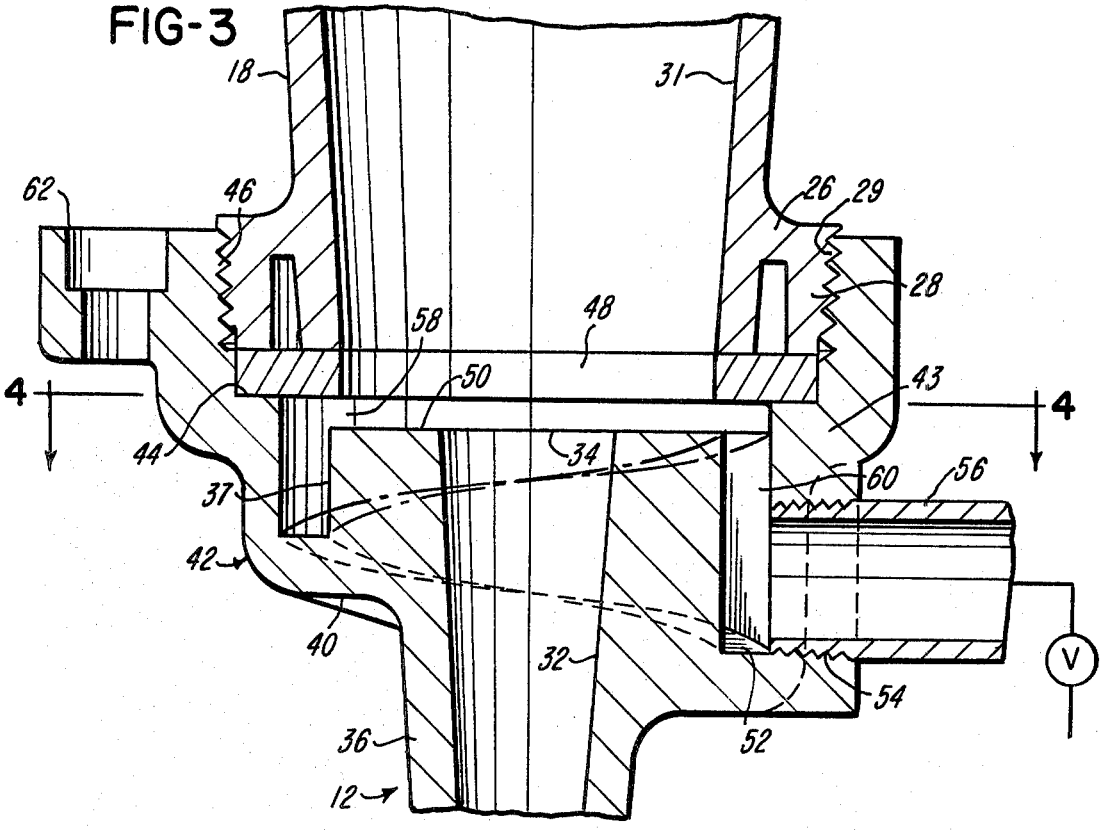
FIG. 3 is a vertical section further illustrating the invention features.
Figure 4:
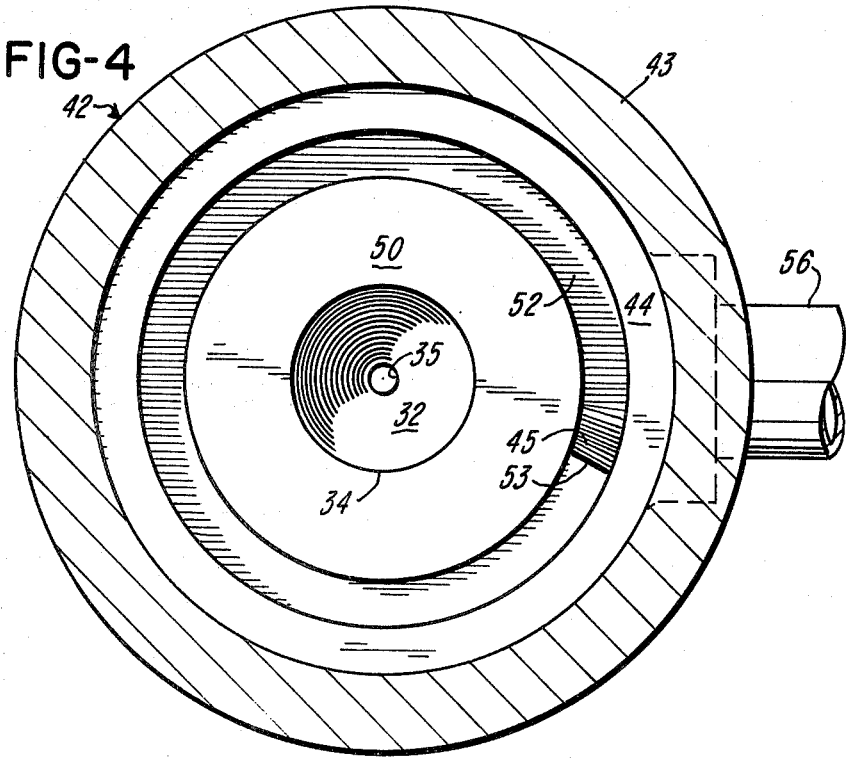
FIG. 4 is a view taken on line 4—4 of FIG. 3.

FIGS. 5, 6, and 7 illustrate modifications of the embodiment of invention shown in FIGS. 1–4.

Like parts are indicated by similar characters of reference throughout the several views.

Referring to the accompanying drawings, the illustrated embodiment of the invention provides a housing forming a separating chamber 9 comprised in the main of two coaxially connected parts 10 and 12. The respective relation of these parts will be described as referenced to their orientation shown in FIG. 1 of the drawings. The part 10 is shown as the upper part and the part 12 as the lower part.

The upper part 10 comprises a tubular shell segment 14 the upper end section 16 of which is capped by a centrally apertured closure plate 20 and has a cylindrical configuration. The interior diameter of the section 16 is uniform throughout its length. A tubular wall section 18 having the shape of a downwardly convergent truncated cone is integral with and forms a coaxial extension of the lower end of the section 16. The interior diameter of the connected end of the section 18 is the same as that of the section 16.

Fixed perpendicular to the plate 20 and projected through its central aperture is a tube which defines an overflow nozzle 22. One end portion of this nozzle positions interiorly of the section 16 and in coaxially spaced relation to its inner wall while its opposite end projects outwardly for suitable connection to apparatus designed to receive the accepts from the cleaner of which the nozzle 22 forms a part.

An integral tube-like connection 24 to the upper end of the section 16 the discharge end of which rims an opening therein adjacent the closure plate 20 defines a tangential inlet to the uppermost end of the chamber 9, which is bounded by the inner wall surface 31 of the shell segment 14. The exterior surface of the section 18 is provided with an external flange 26 in a location adjacent and in spaced relation to its lower truncated extremity. The radial extent of the flange 26 is relatively short. Formed integral with the outer peripheral limit of the flange 26 is a cylindrically configured skirt 28 which is axially directed to position about and in a generally spaced concentric relation to the convergent lower extremity of the section 18. The lowermost extremity of the skirt 28 and that of the truncated end of the section 18 occupy a common plane. The skirt 28 is provided with an external thread 29.

The part 12 comprises as its central main body portion 36 a tubular structure the inner wall surface 32 of which has a form of that of an elongated, downwardly convergent (FIG. 1) truncated cone the interior diameter of which at its larger diameter end 34 is significantly less than the minimum of that of the shell segment 14.

The body portion 36 has a generally cylindrical exterior configuration modified at a location in adjacent spaced relation to what is shown as its uppermost end surface 50 by an integral outwardly projected spirally configured flange 40. The flange 40 provides the base of a cup-like projection 42, the peripheral wall 43 of which extends about and in radially spaced relation to the end portion of the main body 36 above the flange and substantially beyond the end surface 50. In a plane beyond, adjacent and parallel to that occupied by the surface 50, the projected extremity of the cup-like formation 42 is expanded to form in the inner surface of the wall 43 an upwardly and outwardly facing shoulder 44. The inner surface portion 46 of the wall 43 upwardly from and beyond the shoulder 44 is cylindrically configured and formed with a thread complementary to that on the outer surface of the skirt 28.

As will be seen from FIG. 3 of the drawings, in the connection of the parts 10 and 12 the projected internally threaded extremity of the wall 43 threadedly engages about the skirt 28 on the truncated lower end of the shell segment 14. Seated on the shoulder 44 to position between this shoulder and the concentric, co-planar, annular, lower end surfaces of the section 18 provided by its truncated extremity and the projected extremity of the skirt 28 is a spacer ring 48. The inner diameter of the ring 48 is identical in size with that of the lower end of the wall surface 31.

The shoulder 44 and thereby the lower surface of the spacer ring 48 lies in a plane which is in parallel spaced relation to the adjacent surface 50 of the body portion 36 of the part 12. In the radial spacing between the wall portion 43 and the outer surface of the body portion 36 within the cup-like projection 42 is a spirally configured surface 52 formed integral therewith and with the upper and innermost surface of the flange 40. This surface 52 has one end defined by a radial line 53 in the plane occupied by the surface 50 and extends therefrom about and longitudinally of the upper end portion of the body 36 within the projection 42 through a 360° arc. This arc terminates adjacent the inner end of a radial aperture 54 in the wall 43 which opens from its exterior surface. One end of a primary rejects discharge pipe 56 is fixed in the aperture 54 to provide that this pipe projects outwardly from the base of the cup-like projection 42.

As seen in FIG. 3, the outer dimension of surface 50 is slightly greater than that of the interior dimension of the ring 48 while its interior diameter is substantially smaller than that of the ring 48. This prescribes that substantially all of the inner surface 50 is presented as an obstruction to the outer peripheral portion of a vortex flow developed in the segment 14 on entrance of a slurry to the chamber 9 by way of its tangential inlet 24. Moreover, the axial spacing between the inner edge of the ring 48 and the outer peripheral edge of the surface 50 provides an annular orifice 58. The orifice 58 communicates on the one hand with the interior of the portion of the cleaner separating chamber 9 defined by the segment 14 and on the other with a channel 60 peripheral to the surface 50 the base of which is the spirally developed surface 52. By reason of the latter the depth of the channel 60 gradually increases from the line 53 to its end adjacent aperture 54.

Apertured ears 62 peripherally project from the outer edge of the wall 43 serve for the mount of the centrifugal cleaner assembly above described in any orientation that its application may require.

The annular orifice 58 may be enlarged by interposing one or more rings 64 of selected thickness between the shoulder 44 and ring 48, the inner diameter of which rings 64 should preferably be no smaller than that of the inner periphery of the shoulder 44. See FIG. 5 in this respect.

The annular orifice may be reduced by substituting for the ring 48 one including a projection 66 bounding and forming an axial extension of the inner peripheral portion of its surface lying within the wall 43 and opposite the outer peripheral edge of the surface 50. See FIG. 6 in this respect.

In some cases one may desire a plurality of spaced orifices rather than a single annular orifice. In such event, the space of the single annular orifice may be divided by a spacer ring 48' such as shown in FIG. 7 wherein the axial extension 68 of the inner edge of the ring bridges the space shown between the ring 48 and the surface 50 in FIG. 3 and by notches 17 therein forms with the surface 50 a plurality of circularly spaced orifices.

In any case the end result of the invention structure, particularly the preferred embodiment of which at this time is shown in FIGS. 1–4, is that as a slurry such as one embodying "whole tree" chips which have been passed through a single refining stage is directed through the tangential inlet 24 it will develop a vortex like flow pattern. As the slurry moves through the separating chamber 9 it will have a substantial segment of its outer peripheral portion obstructed and deflected by the surface 50. Tests have unexpectedly shown that with this obstructing surface 50, adjacent the outer peripheral edge of which is the orifice 58, the bark, cambium layer, and other impurities which appear in the slurry do not as a result of their presence upset the operation of a cleaner as found to happen in the use of conventional cleaners as previously described. Instead what happens is that the surface 50 deflects a relatively dilute portion of the slurry including light bark, cambrium layer, shives and large fibrous particles through the orifice 58 and thereby through the discharge passage formed by the channel 60 the base of which is the spiral surface 52 to the exit opening from the cleaner provided by the aperture 54. The cross section of channel 60 is maintained so as to insure generally uniform flow velocity, thereby to prevent deposit of contained solids and plugging. Unexpectedly not only do the light and large particles of solids in the slurry exit through the orifice 58 but the heavy and smaller dirt particles and other heavy relatively useless solids in the slurry are caused to move to and through the passage central to the part 12 as defined by its inner wall surface 32 to exit in relatively high consistency form from the opening 35 defined at its lower end as the second "rejects" fraction which is separated from the slurry. Within the chamber 9 the slurry does conventionally develop a central counterflowing vortex to which, it is found in tests, the relatively light and long more desirable fibers and fiber particles move or are carried under the influence of the natural forces inherent in the movement of the slurry in the structure described. The resultant inner vortex flow produces high quality accepts which are directed from the cleaner by way of its overflow nozzle 22.

Thus, the use of the invention units under the most difficult conditions and applied to the most difficult of slurries has proven that they solve the problems first mentioned, and in an economical fashion.

Note moreover the flexibility of application and ease of modification of the improved centrifugal cleaner units such as here described.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for centrifugally separating and/or cleaning the solids content of a fiber pulp slurry comprising means defining an axially extended separating chamber including, at one end of said chamber, inlet means for introducing a pulp slurry in a vortex type flow pattern and a first axial outlet, said chamber means further comprising a bounding wall surface including a portion tapering toward a second axial outlet at an end opposite said one end of said chamber, a further outlet comprising an annular opening interrupting said tapering portion of said bounding wall surface, means defining a generally planar annular surface facing said one end of said chamber and presenting an obstruction to a substantial segment of said vortex flow and defining an edge portion of said annular opening remote from said one end, the inner diameter of said annular surface comprising a resumption of said tapering portion of said bounding wall surface and the outer diameter of said annular surface being at least as large as the diameter of said bounding wall surface as it tapers to said annular opening.

2. Apparatus as in claim 1 characterized in that said first outlet is defined by an overflow tube which is coaxial with said second outlet.

3. Apparatus as in claim 1 characterized in that said annular opening is adjacent the outer peripheral limit of said annular surface.

4. Apparatus as in claim 1 characterized by said means defining said separating chamber being a multipart structure including one part connected to provide a coaxial extension of the preceding part, each said part having a tubular configuration and a portion of an end surface of said one part being configured and positioned to provide said annular surface.

5. Apparatus as in claim 4 characterized in that said one part includes means for coupling said one part to said preceding part to provide an axially spaced relation between the adjacent ends of the tubular configurations of said parts to form therebetween said annular opening, said annular opening being communicated with a passage from said chamber intermediate the ends thereof.

6. Apparatus as in claim 5 characterized in that said passage is located outwardly of said obstructing surface and extends in a direction longitudinally of said chamber.

7. Apparatus as in claim 1 characterized in that said means defining an axially extended separating chamber is comprised of at least two sections each of which has a bore forming part of said chamber and said bounding wall surface, the bore of one of which is substantially reduced in cross section from the bore of the preceding section and said annular surface has its inner limit defining the end of the bore of said one section which is most adjacent the bore of the preceding section.

8. Apparatus as in claim 7 wherein said one of said sections includes, at the end thereof embodying said annular surface, means defining a cup-like flange projected outwardly and axially thereof to telescopically nest with the adjacent end of the preceding of said sections and to establish the bores of the respective sections in said spaced relation and means incorporated with said sections to produce a selective end spaced relation of their bores.

9. Apparatus as in claim 8 characterized in that said cup-like flange defines a helical channel in rimming relation to said annular surface open at one end to the space between the respective bores of said sections and at the other end to said further outlet.

10. Apparatus as in claim 1 wherein said means defining said separating chamber is a housing including a separable part embodying at one end thereof said second axial outlet which is one end of a bore therein the other end of which is bounded by said annular surface, immediately in advance of which is said annular opening which is formed in the connection of said separable part to the remainder of said means defining said separating chamber.

11. Apparatus as in claim 1, wherein valve means are provided in connection with said further outlet for control of the discharge therefrom.

* * * * *

UNITED STATES PATENT AND TRADEMARK OFFICE

CERTIFICATE OF CORRECTION

PATENT NO. : 4,392,950

DATED : July 12, 1983

INVENTOR(S) : James P. Beery

It is certified that error appears in the above-identified patent and that said Letters Patent is hereby corrected as shown below:

Column 8, line 22, claim 8, line 7, "said" should read -- end --.

Signed and Sealed this

*Third* Day of *January 1984*

[SEAL]

*Attest:*

GERALD J. MOSSINGHOFF

*Attesting Officer*

*Commissioner of Patents and Trademarks*